US011405709B1

(12) United States Patent
Zhang

(10) Patent No.: US 11,405,709 B1
(45) Date of Patent: Aug. 2, 2022

(54) HEARING AID MICROPHONE STRUCTURE AND HEARING AID

(71) Applicant: Xiamen Retone Hearing Technology Co., Ltd., Xiamen (CN)

(72) Inventor: Chengxiang Zhang, Xiamen (CN)

(73) Assignee: XIAMEN RETONE HEARING TECHNOLOGY CO., LTD., Xiamen (CN)

( * ) Notice: Subject to any disclaimer, the term of this patent is extended or adjusted under 35 U.S.C. 154(b) by 0 days.

(21) Appl. No.: 17/338,717

(22) Filed: Jun. 4, 2021

(30) Foreign Application Priority Data

Mar. 19, 2021 (CN) ..... 202110305661.5

(51) Int. Cl.
*H04R 1/08* (2006.01)
*H04R 25/00* (2006.01)
*H04R 1/34* (2006.01)

(52) U.S. Cl.
CPC ..... *H04R 1/086* (2013.01); *H04R 1/342* (2013.01); *H04R 25/604* (2013.01); *H04R 25/609* (2019.05); *H04R 25/65* (2013.01)

(58) Field of Classification Search
CPC .... H04R 1/342; H04R 25/604; H04R 25/609; H04R 25/65; H04R 1/086; H04R 2225/023; H04R 1/083; H04R 2410/07
See application file for complete search history.

(56) References Cited

U.S. PATENT DOCUMENTS

2017/0118567 A1* 4/2017 Larssen ..... H04R 25/654
2020/0413207 A1* 12/2020 Wichmann ..... H05K 1/181

FOREIGN PATENT DOCUMENTS

CN 203167211 U 8/2013
CN 205622877 U 10/2016

* cited by examiner

*Primary Examiner* — Sunita Joshi
(74) *Attorney, Agent, or Firm* — Bayramoglu Law Offices LLC

(57) ABSTRACT

A hearing aid microphone structure and a hearing aid are provided. The hearing aid microphone structure includes a microphone, a sound-guiding foam and a dust-proof net. The microphone is arranged on a front surface of a first end plate in a housing, wherein the first end plate is a part of a flexible circuit board, and the first end plate has a sound transmission hole. The sound-guiding foam arranged on a rear surface of the first end plate, wherein the sound-guiding foam has a sound-guiding hole, and the sound-guiding hole is communicated with the sound transmission hole. The dust-proof net arranged on the sound-guiding foam, wherein the dust-proof net has a peripheral portion and a net portion, and the net portion is blocked in front of the sound-guiding hole.

16 Claims, 10 Drawing Sheets

HEARING AID MICROPHONE STRUCTURE AND HEARING AID

CROSS REFERENCE TO THE RELATED APPLICATIONS

This application is based upon and claims priority to Chinese Patent Application No. 202110305661.5, filed on Mar. 19, 2021, the entire contents of which are incorporated herein by reference.

TECHNICAL FIELD

The present disclosure relates to the field of hearing aids, in particular to a hearing aid microphone structure and a hearing aid.

BACKGROUND

A hearing aid is usually installed in or behind an ear of a user to amplify the sound for a user. Some common types of hearing aids include behind-the-ear (BTE) hearing aids, in-the-ear (ITE) hearing aids, in-the-canal (ITC) hearing aids, completely-in-canal (CIC) hearing aids, etc.

A CIC hearing aid has the advantages of small size and strong concealment. It does not require an external circuit wire or a microphone tube, so it can meet aesthetic and psychological needs of the deaf.

For more information about existing hearing aids, see the Chinese patents with the announcement No. CN205622877U and CN203167211U.

SUMMARY

The present disclosure provides a new completely-in-canal hearing aid for further improving the hearing aids.

The present disclosure is implemented as follows: it provides a hearing aid microphone structure, including: a microphone arranged on a front surface of a first end plate in a housing, wherein the first end plate is a part of a flexible circuit board, and the first end plate has a sound transmission hole; sound-guiding foam arranged on a rear surface of the first end plate, wherein the sound-guiding foam has a sound-guiding hole, and the sound-guiding hole is communicated with the sound transmission hole; a dust-proof net arranged on the sound-guiding foam, wherein the dust-proof net has a peripheral portion and a net portion, and the net portion is blocked in front of the sound-guiding hole.

Optionally, the flexible circuit board further has a second end plate and an annular portion bent into an annular shape; a first connecting section is arranged between the first end plate and the annular portion, and a second connecting section is arranged between the second end plate and the annular portion; the first connecting section and the second connecting section intersect, and the intersection becomes an intersection position of the annular portion.

Optionally, the hearing aid microphone structure may further include a bracket, wherein the bracket has an opening, the first connecting section and the second connecting section pass through the opening to be hooped together by the bracket, and the first end plate and the second end plate are fixed on the bracket.

Optionally, the hearing aid microphone structure may further include a rear cover, wherein a rear section of the housing has a rear opening, and the rear cover covers the rear opening.

Optionally, the rear cover is assembled with the bracket; the microphone, the sound-guiding foam and the dust-proof net are located between the rear cover and the bracket; the first end plate and the second end plate are also located between the rear cover and the bracket.

The present disclosure further provides a hearing aid, including the hearing aid microphone structure.

The hearing aid microphone structure of the present disclosure:

The hearing aid microphone structure includes: a microphone arranged on a front surface of a first end plate in a housing, wherein the first end plate is a part of a flexible circuit board, and the first end plate has a sound transmission hole; sound-guiding foam arranged on a rear surface of the first end plate, wherein the sound-guiding foam has a sound-guiding hole, and the sound-guiding hole is communicated with the sound transmission hole; a dust-proof net arranged on the sound-guiding foam, wherein the dust-proof net has a peripheral portion and a net portion, and the net portion is blocked in front of the sound-guiding hole. At this point, the microphone and the sound-guiding foam sandwich the first end plate to ensure that the microphone receiving sound faces outward through the sound transmission hole. The sound-guiding foam can make the sound receiving effect better, and the cooperation of the sound-guiding foam and the dust-proof net ensures that the sound can be better transmitted to the microphone under the dust-proof protection effect. Therefore, the hearing aid microphone structure is not only of a compact structure, but also has a good effect of receiving external sound and a good dust-proof effect.

The related structural design of the microphone structure is regular. The sound-guiding foam and the dust-proof net cooperate to protect the microphone, and then cooperate with the first end plate, bracket and rear cover to ensure that the microphone is located at the rear of the hearing aid so as to better obtain external sound and make the size of the entire hearing aid small.

DETAILED DESCRIPTION OF THE EMBODIMENTS

The embodiments described below with reference to the drawings are illustrative, intended to explain the present disclosure rather than a limitation.

The present disclosure of this embodiment provides a completely-in-canal hearing aid. A hearing aid generally includes a left ear hearing aid and a right ear hearing aid which are symmetrical. This embodiment only describes the left ear hearing aid. Since the right ear hearing aid is symmetrical to the left ear hearing aid in structure, the right ear hearing aid falls within the protection scope of the present disclosure too.

The hearing aid of this embodiment includes a microphone structure. Therefore, this embodiment also provides a hearing aid microphone structure.

Figure 1:
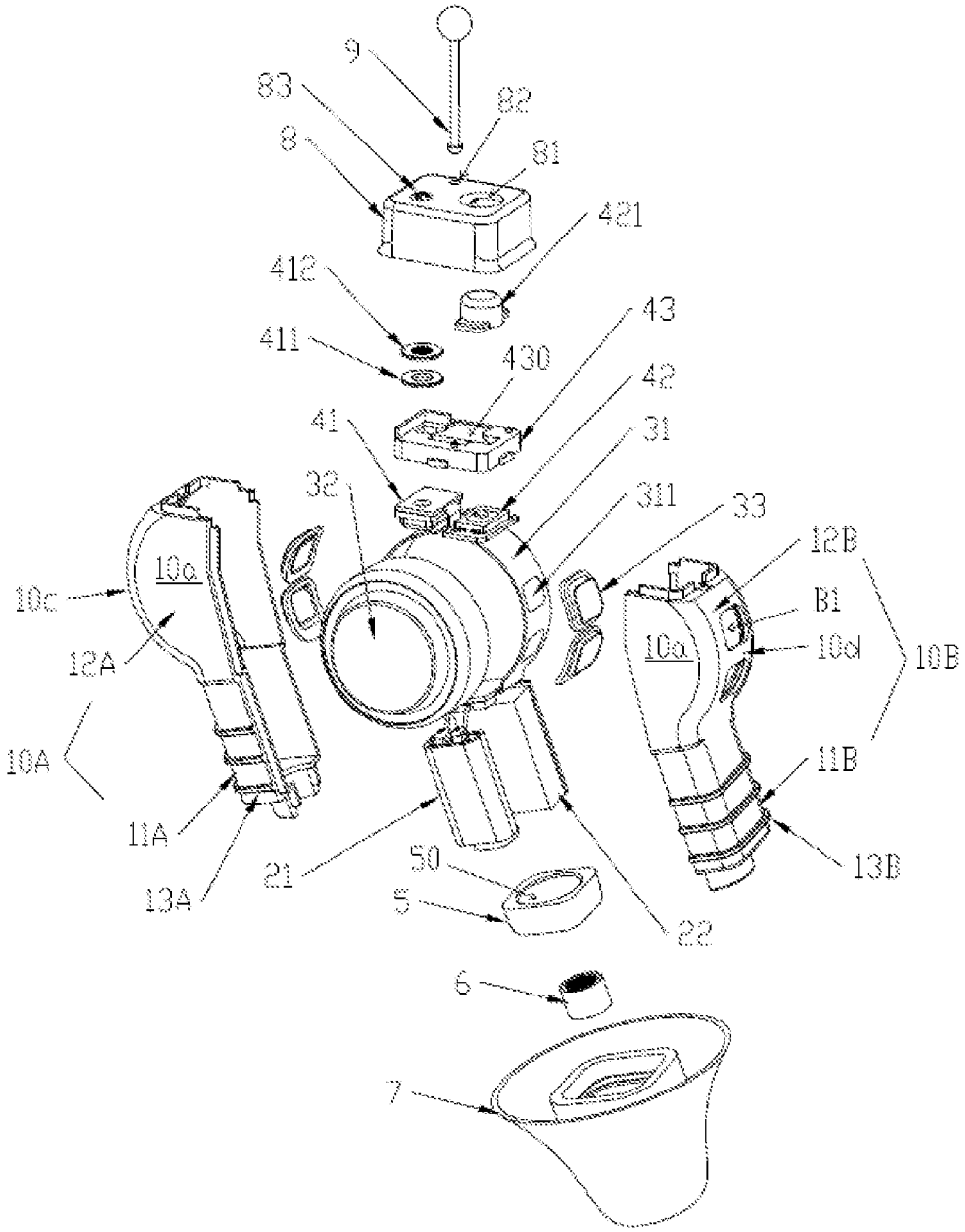
FIG. 1 is an exploded diagram of a hearing aid.

The exploded view of FIG. 1 shows that the hearing aid includes a housing 10 (10 is marked in FIGS. 6 and 7), a receiver 21, a chip 22, a flexible circuit board 31, a battery 32, a conductive contact sheet 33, a microphone 41, a switch 42, a bracket 43, a front cover 5, a cerumen cap 6, an earplug 7, a rear cover 8 and a take-out line 9. The flexible circuit board 31 includes pads 311. Sound-guiding foam 411 and a dust-proof net 412 also cooperate with the microphone 41. A button 421 also cooperates with the switch 42. The front cover 5 has a front through hole 50, and the rear cover 8 is provided with a button hole 81, a wire hole 82 and a sound receiving port 83.

Figure 6:
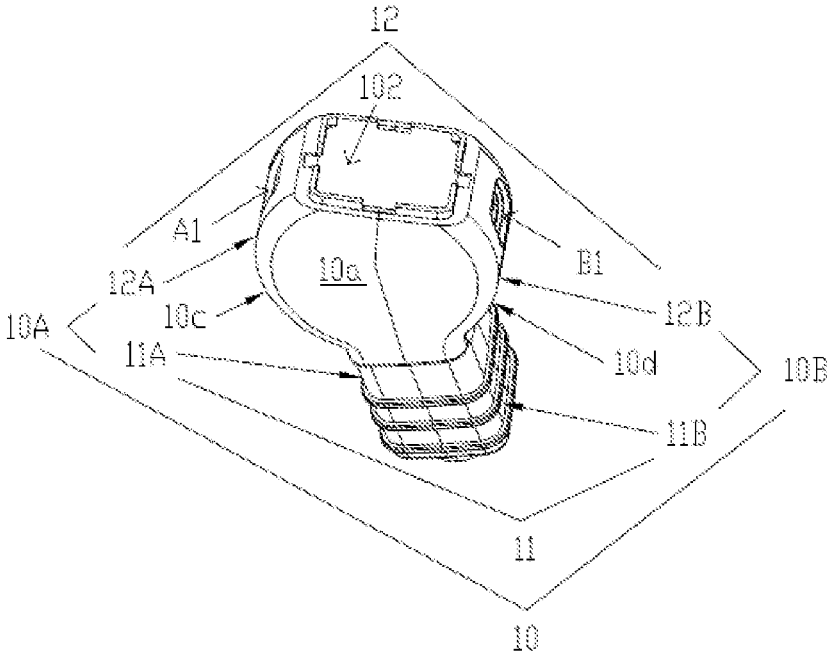
FIG. 6 is a schematic diagram of a housing from a first viewing angle.
Figure 7:
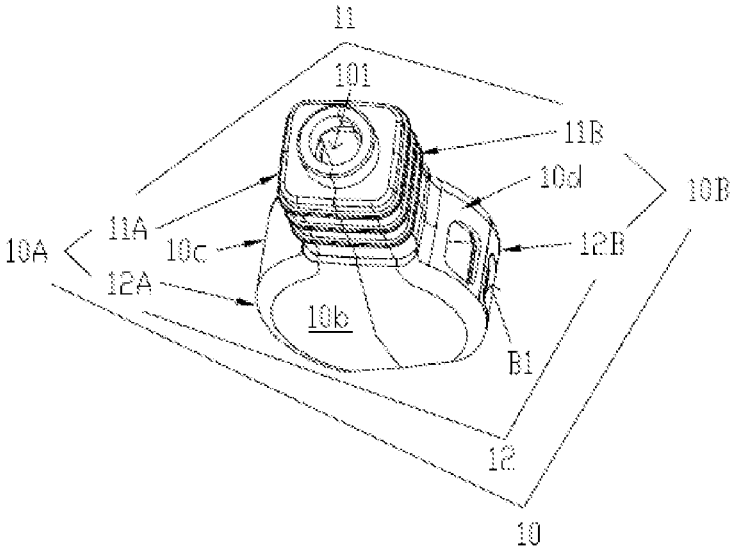
FIG. 7 is a schematic diagram of the housing from a second viewing angle.

In this embodiment, the housing 10 is divided into a front section 11 and a rear section 12, and also into a first housing 10A and a second housing 10B. Referring to FIG. 1, the housing 10 is divided into the first housing 10A and the second housing 10B, wherein the first housing 10A includes a first front section 11A and a first rear section 12A connected to each other, and the second housing 10B includes a second front section 11B and a second rear section 12B connected to each other. Referring to FIGS. 6 and 7, the housing 10 includes the front section 11 and the rear section 12, wherein the front section 11 includes the first front section 11A and the second front section 11B, and the rear section 12 includes the first rear section 12A and the second rear section 12B.

Figure 2:
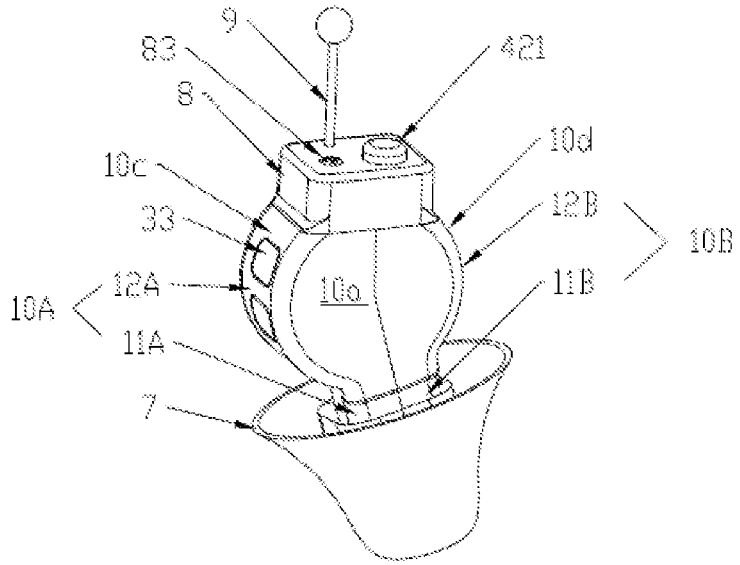
FIG. 2 is a schematic diagram of the hearing aid from a first viewing angle.
Figure 3:
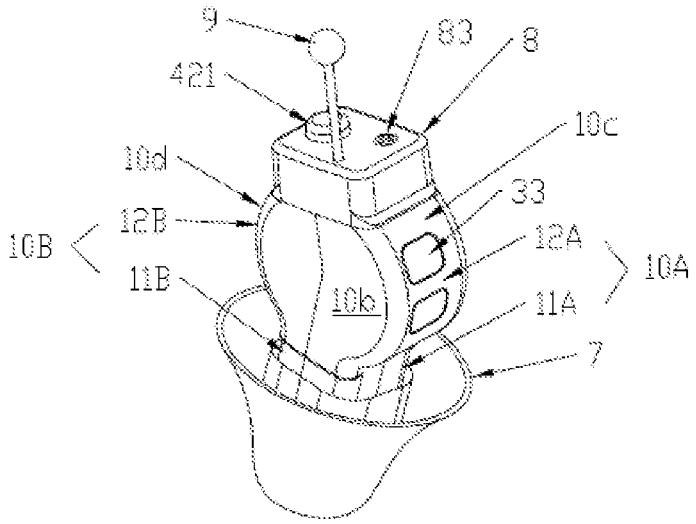
FIG. 3 is a schematic diagram of the hearing aid from a second viewing angle.

Referring to FIGS. 2 and 3, the overall appearance of the hearing aid is shown in FIGS. 2 and 3. At this point, the first housing 10A and the second housing 10B are assembled together. In FIGS. 2 and 3, the lower end of the structure corresponds to the front end of the hearing aid, and the upper end of the structure corresponds to the rear end of the hearing aid. It can be seen from FIGS. 1 to 5 that the front cover 5 is disposed at the front end of the first front section 11A and the second front section 11B, and the earplug 7 is assembled at the front end of the hearing aid through the front cover 5, that is, the earplug 7 is assembled at the front end of the housing 10, that is, the earplug 7 is disposed at the front end of the first front section 11A and the second front section 11B. Further, the earplug 7 is assembled at the front end of the first front section and the second front section through the front cover 5, and the earplug 7 is specifically assembled at the front end of the first front section 11A and the second front section 11B through the front cover 5, and the earplug 7 is connected and fixed to the front end of the first front section 11A and the second front section 11B through the front cover 5.

The earplug 7 used in this embodiment is a horn-shaped earplug. In other embodiments, the earplug may be in other shapes.

Referring back to FIG. 1, an outer surface of the first front section 11A has a first outer convex edge 13A, and an outer surface of the second front section 11B has a second outer convex edge 13B. The first outer convex edge 13A and the second outer convex edge 13B are used for fitting the assembly of the earplug 7 so that the earplug 7 is not easy to fall off Referring to FIG. 6, the rear section 12 has a rear opening 102. Referring to FIG. 7, the front section 11 has a front opening 101.

It can be seen from FIGS. 1 to 5 that the cerumen cap 6 is installed between the front opening 101 and the front end of the first front section 11A and the second front section 11B, that is, installed between the front cover 5 and the front end of the housing 10, and between the front cover 5 and the front end of the first front section 11A and the second front section 11B. In addition, it can be seen from FIGS. 1 to 9 that the cerumen cap 6 is arranged in the front through hole 50 of the front cover 5.

FIGS. 2 and 3 further show that when the earplug 7 is horn-shaped, the widest part of the entire hearing aid is only the diameter of the horn edge of the earplug 7. The width of the housing 10 is smaller than the diameter of the horn edge, and the thickness of the housing 10 is smaller, so that the hearing aid has a compact structure, the entire hearing aid can basically enter a user's ear canal, and the hearing aid is a completely-in-canal hearing aid.

Figure 4:
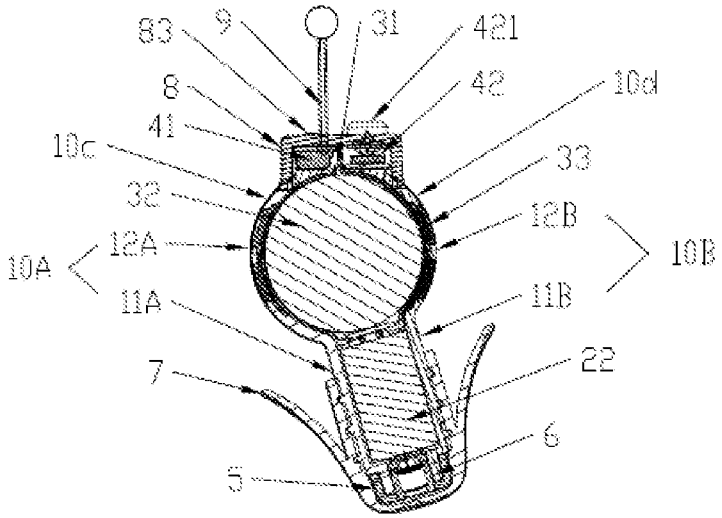
FIG. 4 is a schematic diagram of a first cross-sectional structure of the hearing aid.
Figure 5:
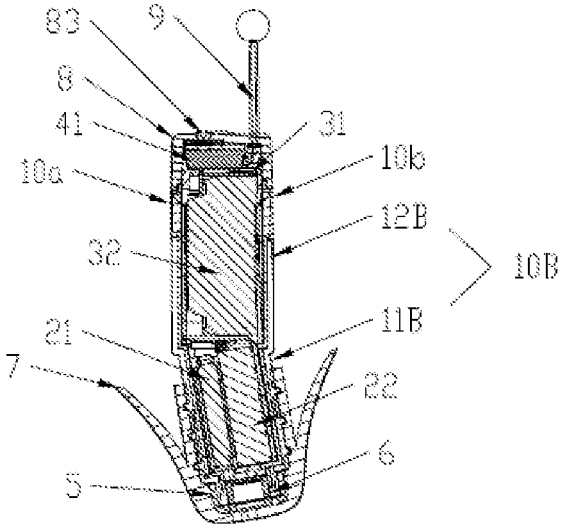
FIG. 5 is a schematic diagram of a second cross-sectional structure of the hearing aid.

FIGS. 4 and 5 show the cross-sectional structure of the hearing aid from two different viewing angles, wherein FIG. 4 is a cross section obtained by cutting a plane parallel to the length and width of the hearing aid, and FIG. 5 is a cross section obtained by cutting a plane parallel to the thickness and length of the hearing aid. It can be seen from the two cross-sectional views that the hearing aid is compact, so the size can be small.

FIGS. 4 and 5 also show that the flexible circuit board 31 is on the peripheral side of the battery 32. FIG. 4 shows that the battery 32 inside the housing 10 is the structure with the largest width. Therefore, the width of the housing 10 only needs to be slightly larger than that of the battery 32, which further proves that the entire hearing aid is small in width and size.

Referring to FIGS. 1 to 5, the receiver 21 and the chip 22 are located in the front section 11 of the housing 10, which helps to reduce the size of the hearing aid and also ensures that the user can get a greater sound output and the whole structure is stable and durable.

Referring to FIGS. 1 to 5, the battery 32 is located in the rear section 12 of the housing 10, and a large portion of the rear section 12 is similar in appearance to the battery 32 with reference to FIG. 4, which again helps to reduce the size of the hearing aid.

Referring to FIGS. 1 to 9, the appearance of the front section 11 is basically a chamfered cuboid, the chip 22 is a cuboid, and the receiver 21 is also substantially a cuboid.

Figure 10:
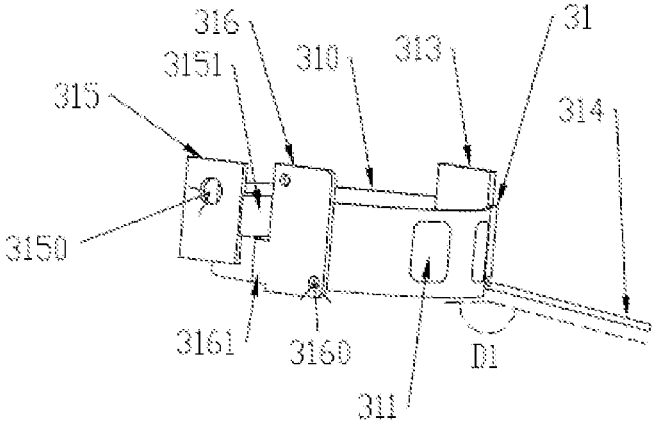
FIG. 10 is a schematic diagram of a flexible circuit board from a first viewing angle.
Figure 11:
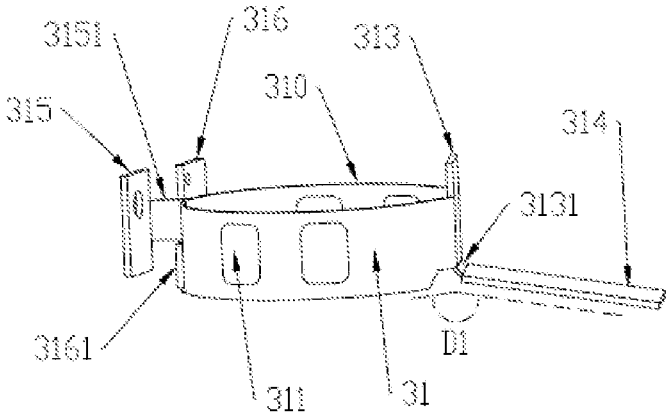
FIG. 11 is a schematic diagram of the flexible circuit board from a second viewing angle.

The chip 22 is arranged on a part of the flexible circuit board 31, and specifically arranged on a chip portion 314, as shown in subsequent FIGS. 10 and 11; the receiver 21 is electrically connected to the flexible circuit board 31 through a corresponding wire (not marked), and specifically electrically connected to a device portion 313, as shown in subsequent FIGS. 10 and 11.

Figure 8:
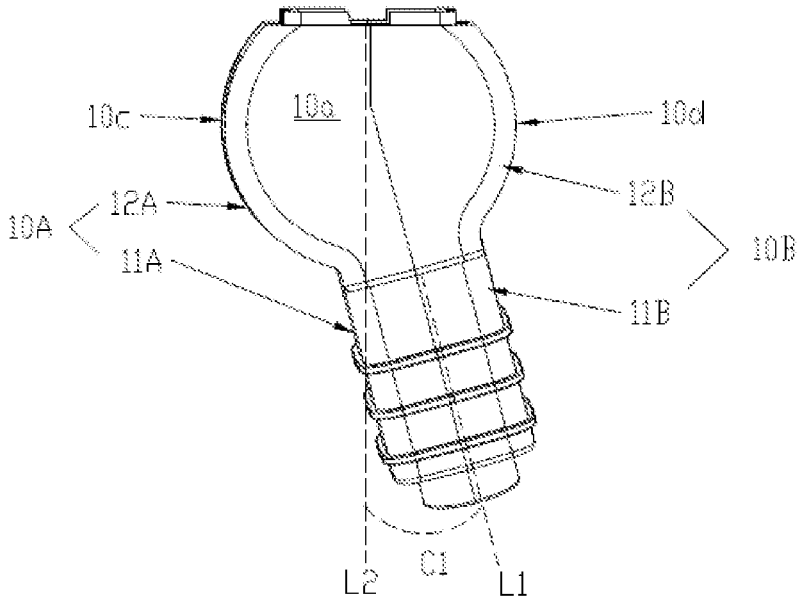
FIG. 8 is a schematic diagram of the housing from a third viewing angle.

Referring to FIGS. 1 to 9, the two opposite surfaces (i.e., the first surface 10*a* and the second surface 10*b*) of the rear section 12 are planes. In FIG. 1, the first surface 10*a* is divided into two parts, and FIGS. 2, 6 and 8 show that the two parts are joined together.

Referring to FIGS. 1 to 9, the rear section 12 has two substantially symmetrical opposite side surfaces, and the two opposite side surfaces are a first side surface 10*c* and a second side surface 10*d*, respectively. That is to say, the first housing 10A and the second housing 10B each have an opposite side surface, the first housing 10A has the first side surface 10*c*, and the second housing 10B has the second side surface 10*d*.

The first side surface 10*c* is a part of a basically cylindrical side surface, and the second side surface 10*d* is the other part of the basically cylindrical side surface. The two side surfaces are basically symmetrical. However, the first side surface 10*c* may be slightly larger than the second side surface 10*d* (without affecting the basic symmetry of them), and the length of the first side surface 10*c* is slightly longer than the length of the second side surface 10*d*, as shown in FIG. 8. The length difference is usually on the order of millimeters, such as 2.59 mm, without affecting the basic symmetry of the two side surfaces.

In summary, in one aspect, the front section 11 has a cuboid hollow cylindrical structure as a whole, and the receiver 21 and the chip 22 are tightly arranged in the front section 11; in another aspect, the first surface 10*a*, the second surface 10*b*, the first side surface 10*c* and the second side surface 10*d* of the rear section 12 define a relatively regular flat structure, and the appearance of the rear section 12 is roughly similar to that of the battery 32, that is, the design of the two opposite surfaces and the two opposite side surfaces of the rear section 12 causes the battery 32 to be tightly located in the rear section 12 to reduce the width and size of the hearing aid. Therefore, both aspects help to reduce the size of the hearing aid.

In this embodiment, the front section 11 has a first central axis parallel to the length thereof. The rear section 12 has a second central axis located between the two opposite surfaces (the first surface 10*a* and the second surface 10*b*) and between the two opposite side surfaces (the first side surface 10*c* and the second side surface 10*d*). The first central axis and the second central axis are different straight lines, that is, there will be an included angle greater than zero between the two central axes.

In FIG. 8, the first central axis of the front section 11 is embodied as dashed line L1, and the second central axis of the rear section 12 is embodied as dashed line L2, and the two lines are different straight lines.

Figure 9:
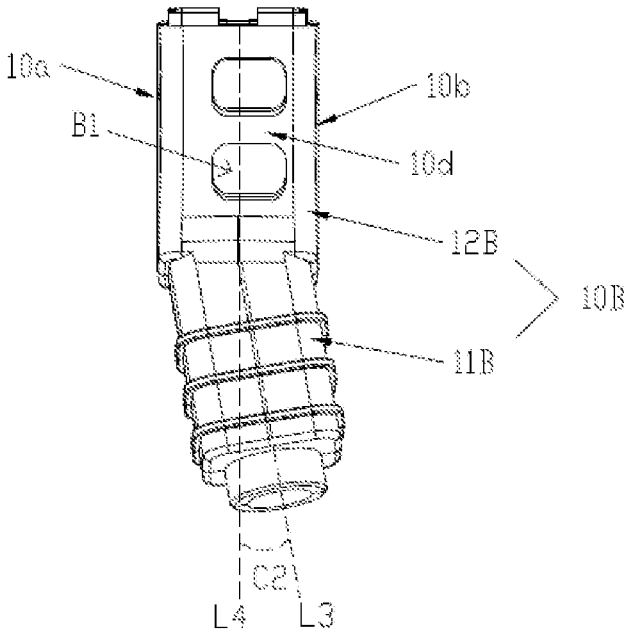
FIG. 9 is a schematic diagram of the housing from a fourth viewing angle.

In FIG. 9, the first central axis of the front section 11 is embodied as dashed line L3, and the second central axis of the rear section 12 is embodied as dashed line L4, indicating again that the two lines are different straight lines.

In this embodiment, the first central axis of the front section 11 and the second central axis of the rear section 12 are designed to be different straight lines, so that the appearance of the hearing aid is more ergonomic, and at the same time, it is beneficial to reduction of the size.

In FIG. 8, an included angle between dashed line L1 and dashed line L2 is the included angle between the aforementioned two central axes at the viewing angle shown in FIG. 8. This included angle is also an included angle between a first plane (not marked) and a second plane (not marked). A plane bisecting the width of the front section 11 and bisecting the front opening 101 is the first plane (that is, the first plane can be represented by dashed line L1 in FIG. 8), and a plane bisecting the width of the rear section 12 and bisecting the rear opening 102 is the second plane (that is, the second plane can be represented by dashed line L2 in FIG. 8).

In this embodiment, the included angle C1 between the first plane and the second plane is designed to be 5-30 degrees. If the included angle C1 is larger than this angle range, it will not be beneficial to the use by human ears, and if the included angle C1 is smaller than this angle range, it will not be beneficial to reduction of the length. At the same time, this angle range is ergonomic.

In FIG. 9, an included angle between dashed line L3 and dashed line L4 is the included angle between the aforementioned two central axes at the viewing angle shown in FIG. 9. This included angle is also an included angle between a third plane (not marked) and a fourth plane (not marked). A plane bisecting the thickness of the front section 11 is the third plane (that is, the third plane can be represented by dashed line L3 in FIG. 9), and a plane bisecting the thickness of the rear section 12 is the fourth plane (that is, the fourth plane can be represented by dashed line L4 in FIG. 9).

In this embodiment, the included angle C2 between the third plane and the fourth plane is designed to be 1-20 degrees. If the included angle C2 is larger than this angle range, it will not be beneficial to the use by human ears, and if the included angle C2 is smaller than this angle range, it will not be beneficial to reduction of the length. At the same time, this angle range is ergonomic.

Besides, the included angle C1 and the included angle C2 coordinate and cooperate with each other, jointly defining the angle relationship between the front section 11 and the rear section 12, which makes the entire hearing aid structure coordinated, and makes the overall shape of the housing 10 resemble the Arabic number6. Such an angle range combined with the shape of the housing makes the overall design exquisite, makes the hearing aid comfortable to wear and easy to take out, achieves good use performance, and ensures that the hearing aid has a small size.

Figure 12:
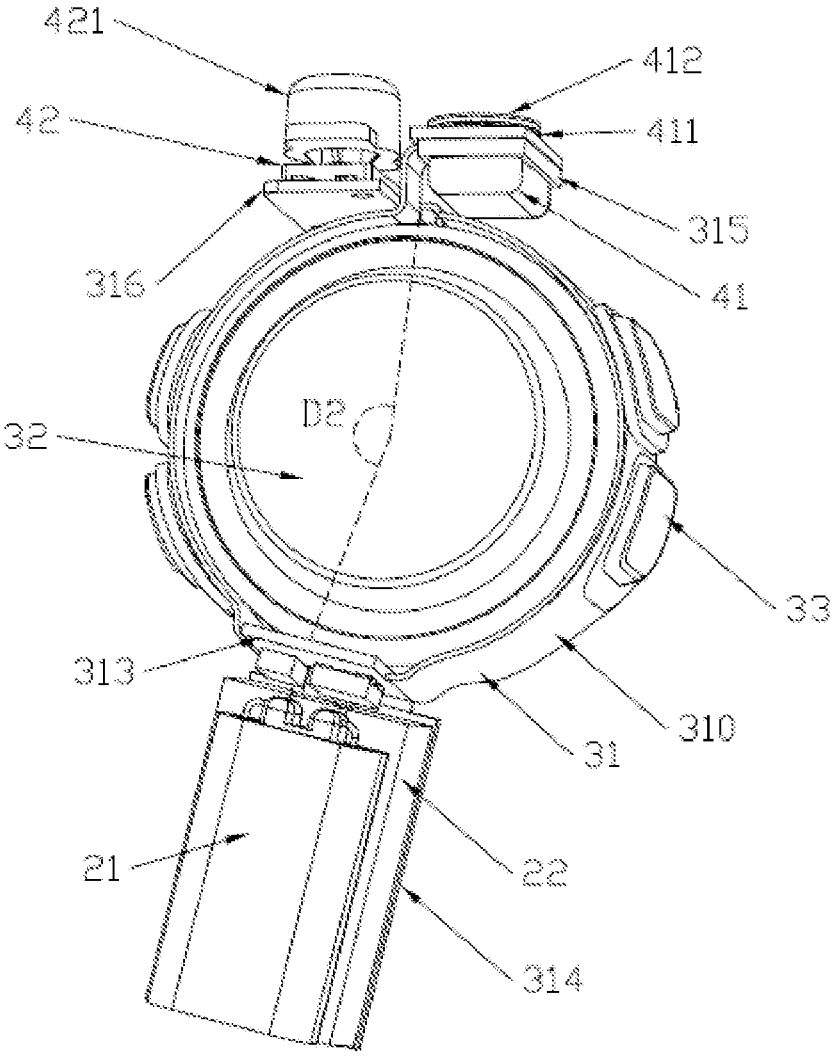
FIG. 12 is a schematic diagram of assembly of a corresponding structure of a flexible circuit board.

In this embodiment, the battery 32 is a button battery and is rechargeable. In this embodiment, the battery 32 is an important factor influencing the shape of the rear section 12 because the inside of the rear section 12 is mainly used for accommodating the battery 32. In this embodiment, the main body of the flexible circuit board 31 is bent into an annular portion 310 (referring to subsequent FIGS. 10 and 11), as shown in FIGS. 4, 5 and 12, specifically the annular portion 310 of the flexible circuit board 31 surrounds the peripheral side of the battery 32, and this is also related to the fact that the battery 32 is a button battery. Specifically, the flexible circuit board 31 may be pasted on the peripheral side of the battery 32 by using double-sided tape (not shown).

In this embodiment, an outer side surface of the first rear section 12A and the second rear section 12B respectively has side holes, the first rear section 12A has two first side holes Al, and the second rear section 12B has two second side holes B1. A conductive contact sheet 33 is assembled in each of these side holes. Four conductive contact sheets 33 are respectively electrically connected to four pads 311 on the outer side surface of the flexible circuit board 31, and reference may be made to FIGS. 1 and 4.

Referring to FIGS. 1, 4 and 5, the bracket 43 is used for fixing an intersection position of the flexible circuit board 31, and the bracket 43 is also used for fixing the switch 42 and the microphone 41 at the same time. Reference may also be made to subsequent FIG. 15. The bracket 43 cooperates with the rear cover 8 to protect the conductive foam 411 and the dust-proof net 412 that cooperate with the microphone 41. Reference may be made to FIGS. 13-16.

Referring to FIGS. 1 and 4, the rear end of the hearing aid is the rear cover 8, and the rear end of the housing 10 is sealed by the rear cover 8. One end of the button 421 is exposed outside the rear cover 8, and the other end is located in the rear cover 8 and pressed against the switch 42, so that the user can control the switch 42 through the button 421.

Referring to FIGS. 1 and 4, the take-out line 9 is installed at the rear cover 8, that is, the rear cover 8 and the take-out line 9 are assembled together. In addition, the main part of the take-out line 9 is exposed from the rear cover 8. The take-out line 9 has a larger end than the wire body (not distinctively marked), and the take-out line 9 is used for facilitating the take-out of the hearing aid.

Referring to FIGS. 1-9, the rear cover 8 of this embodiment is small in size, and the width of the rear cover 8 is smaller than the width of the rear section 12, resulting in a reduced size of the hearing aid, i.e., further ensuring a smaller size of the hearing aid.

The rear section 12 of the housing 10 has a rear opening 102 (as shown in FIG. 6), and the rear cover 8 covers the rear opening 102. At this point, the rear section 12 is like a flat cylindrical structure with two arcuate parts (not shown) cut off. The position where the larger arcuate part is cut off is the position of the rear opening 102, and the position where the smaller arcuate part is cut off is the connection position with the front section 11. The position where the larger arcuate part is cut off is not flat, but there is a part protruding backwards (not marked), as shown in FIGS. 6, 8 and 9, this protrusion becomes a part of the edge of the rear opening 102.

An outer side of the flexible circuit board 31 has a pad 311, the flexible circuit board 31 has a device portion 313 located on the front side of the annular portion 310, the flexible circuit board 31 has a chip portion 314 connected to the bottom end of the annular portion 310, and the flexible circuit board 31 further includes a first end plate 315 and a second end plate 316. The first end plate 315 is used for fixing the microphone 41, and the second end plate 316 is used for fixing the switch 42. This design structure is ingenious and causes the microphone 41 and the switch 42 to be fixed in the desired position in a unique way, that is, the microphone 41 and the switch 42 are very uniquely and ingeniously fixed at a position as close as possible to the rear end of the entire hearing aid, so that the microphone 41 better receives external sound, while the switch 42 is also easier to be manually controlled by the user via the button 421.

Referring to FIGS. 10 and 11, a first connecting section 3151 is connected between the first end plate 315 and the annular portion 310, and a second connecting section 3161 is connected between the second end plate 316 and the annular portion 310. That is to say, the first end plate 315 and the annular portion 310 are connected by the first connecting section 3151, and the second end plate 316 and the annular portion 310 are connected by the second connecting section 3161.

The first connecting section 3151 and the second connecting section 3161 intersect each other, and the intersection becomes an intersection position (not marked) of the annular portion 310. The first end plate 315 and the second end plate 316 expand in two directions from the intersection position. The bracket 43 clamps the intersection through an internal opening 430 thereof (referring to FIG. 1), so that the flexible circuit board 31 maintains a good bending shape as shown in FIGS. 10 and 11. Reference may be made to subsequent FIGS. 13 to 16 in combination with FIG. 4.

FIG. 12 shows that the annular portion 310 is divided into two sections by the device portion 313 and the intersection position. The outer side surface of each section has two pads 311, and each pad has a conductive contact sheet 33.

The device portion 313 is also used for placing a plurality of electronic devices (not marked). For example, one electronic device may be a power field effect transistor, and the other may be a power supply voltage monitor.

Referring to FIG. 10, the first end plate 315 has a sound transmission hole 3150, and the second end plate 316 has two positioning holes 3160. The sound transmission hole 3150 is used for cooperating with the sound reception of the microphone 41, and the positioning holes 3160 are used for the installation of the switch 42.

The chip portion 314 is connected to the bottom end of the device portion 313, and there is a bent connecting portion 3131 there between referring to FIG. 11.

An included angle between the bottom of the chip portion 314 and the bottom surface of the annular portion 310 may be 150-175 degrees. In FIGS. 10 and 11, the included angle is shown by an angle D1, that is, the angle D1 is 150-175 degrees. Such a structure can ensure the fixation of various circuit structures on the flexible circuit board, and make the entire structure small in size, while also ensuring that the corresponding entire hearing aid structure is ergonomic.

The central angle of the device portion 313 and the intersection position at the annular portion 310 may be 160-179 degrees. In FIG. 12, the included angle is shown by a central angle D2, that is, the central angle D2 is 160-179 degrees. Such a structure makes the entire flexible circuit board 31 more stable and small in size, and also ensures that the structure of the hearing aid is more ergonomic.

It can be seen from the foregoing contents that this embodiment also provides a hearing aid microphone structure.

Figure 13:
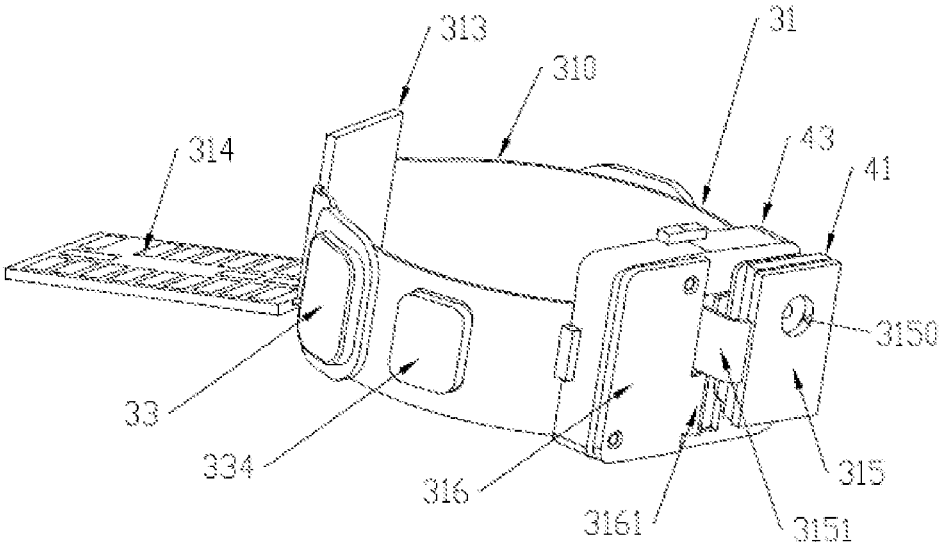
FIG. 13 is a schematic diagram of an assembly structure of a flexible circuit board, a bracket, a conductive contact sheet and a microphone.
Figure 14:
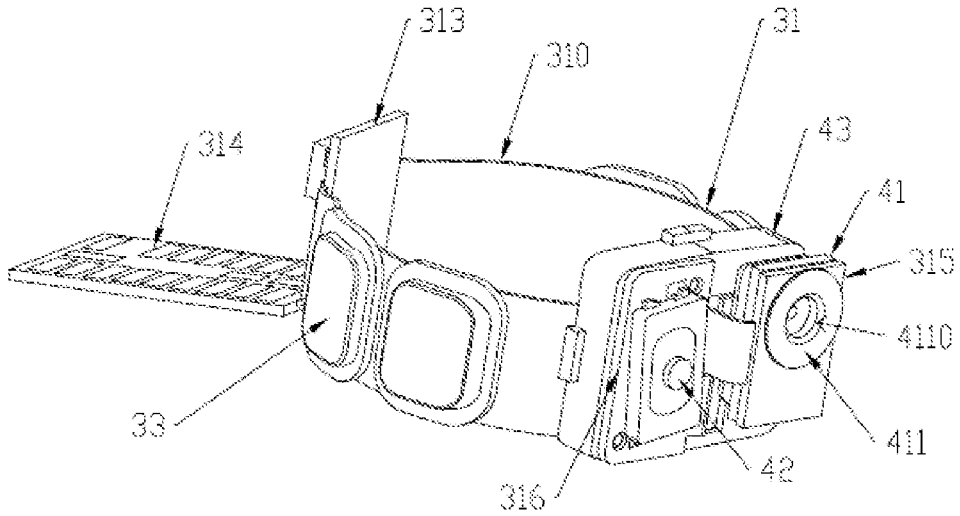
FIG. 14 is a structural schematic diagram of the structure of FIG. 13 continuing to be assembled with sound-guiding foam and a switch.
Figure 15:
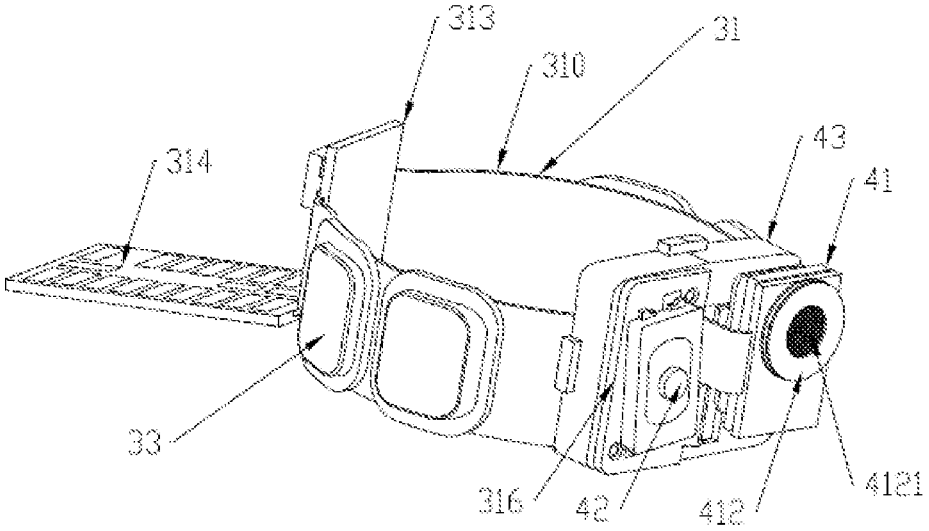
FIG. 15 is a structural schematic diagram of the structure of FIG. 14 continuing to be assembled with a dust-proof net.

The hearing aid microphone structure includes: a microphone 41 arranged on a front surface of the first end plate 315 in a housing 10, wherein the first end plate 315 is a part of a flexible circuit board 31, and the first end plate 315 has a sound transmission hole 3150, referring to FIG. 13; sound-guiding foam 411 arranged on a rear surface of the first end plate 315, wherein the sound-guiding foam 411 has a sound-guiding hole 4110, and the sound-guiding hole 4110 is communicated with the sound transmission hole 3150, referring to FIGS. 13 and 14; a dust-proof net 412 arranged on the sound-guiding foam 411, wherein the dust-proof net 412 has a peripheral portion (not distinctively marked) and a net portion 4121, and the net portion 4121 is blocked in front of the sound-guiding hole 4110, referring to FIG. 15.

The microphone 41 is located on the front surface of the first end plate 315, and the sound-guiding foam 411 and the dust-proof net 412 are located on the rear surface of the first end plate 315. At this point, the microphone 41 and the sound-guiding foam 411 sandwich the first end plate 315 to ensure that the microphone 41 receiving sound faces outward through the sound transmission hole 3150.

The sound-guiding foam 411 can make the sound receiving effect better, and the cooperation of the sound-guiding foam 411 and the dust-proof net 412 ensures that the sound can be better transmitted to the microphone 41 under the dust-proof protection effect. Therefore, the hearing aid microphone structure is not only of a compact structure, but also has a good effect of receiving external sound and a good dust-proof effect.

In this embodiment, the net portion 4121 of the dust-proof net 412 is circular, and the diameter of the net portion 4121 is equal to the diameter of the sound-guiding hole 4110, so that the microphone can better receive external sound.

As described above, the flexible circuit board 31 further has a second end plate 316 and an annular portion 310 bent into an annular shape. A first connecting section 3151 is arranged between the first end plate 315 and the annular portion 310, and a second connecting section 3161 is arranged between the second end plate 316 and the annular portion 310; the first connecting section 3151 and the second connecting section 3161 intersect, and the intersection becomes an intersection position (not marked) of the annular portion 310. The intersection position is located at a rear side of the annular portion 310, and the first end plate 315 and the second end plate 316 are located behind the annular portion 310.

As described above, the hearing aid microphone structure further includes a bracket 43, wherein the bracket 43 uses an opening 430 thereof (referring to FIG. 1) to hoop the first connecting section 3151 and the second connecting section 3161 together, referring to FIG. 13. At the same time, the bracket 43 fixes the first end plate 315 and the second end plate 316 on the bracket 43 together.

Figure 16:
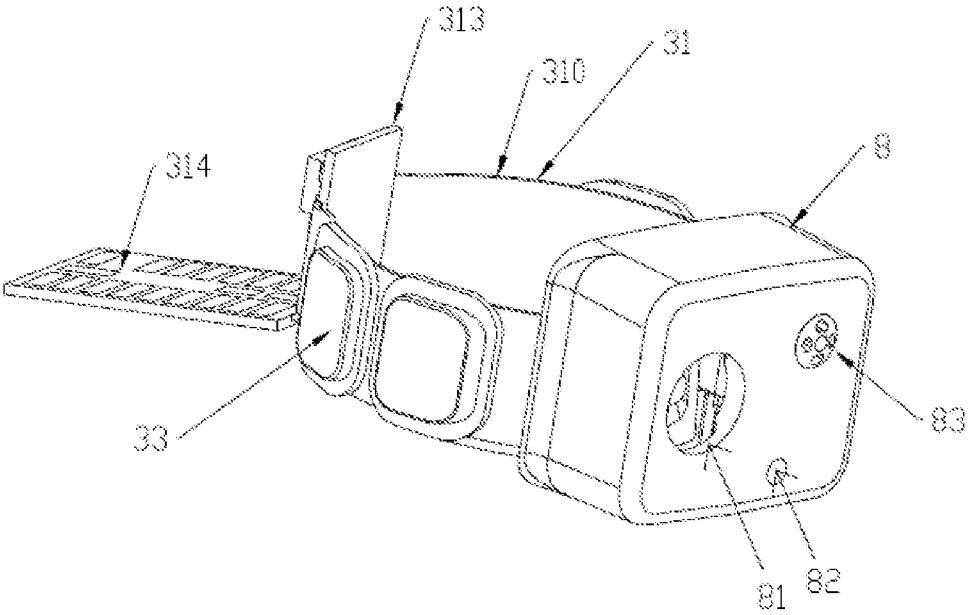
FIG. 16 is a structural schematic diagram of the structure of FIG. 15 continuing to be assembled with a rear cover.

As described above, referring to FIGS. 13 to 16, the rear cover 8 is assembled with the bracket 43; the microphone 41, the sound-guiding foam 411 and the dust-proof net 412 are located between the rear cover 8 and the bracket 43; at the same time, the first end plate 315 and the second end plate 316 are also located between the rear cover 8 and the bracket 43 (inside), wherein the first connecting section 3151 and the second connecting section 3161 pass through the opening 430 of the bracket 43. At the same time, the switch 42 is disposed on the second end plate 316, and the switch 42 is located between the rear cover 8 and the bracket 43. The switch 42 and the microphone 41 are protected by the rear cover 8 inside. FIG. 16 shows only the structure of the rear cover 8 after assembly, and the assembly of the take-out line 9 and the button 421 is omitted.

Figure 17:
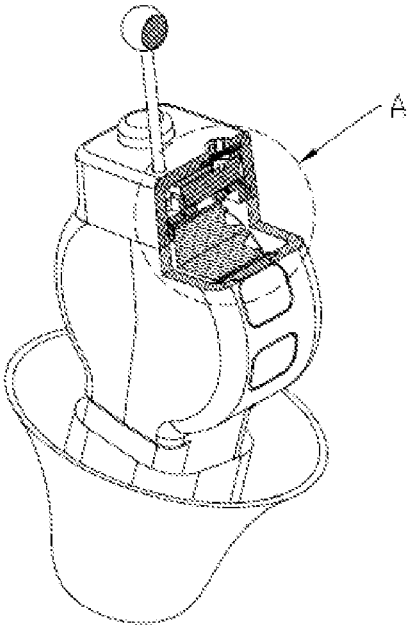
FIG. 17 is a sectioning schematic diagram of the hearing aid at the microphone position.
Figure 18:
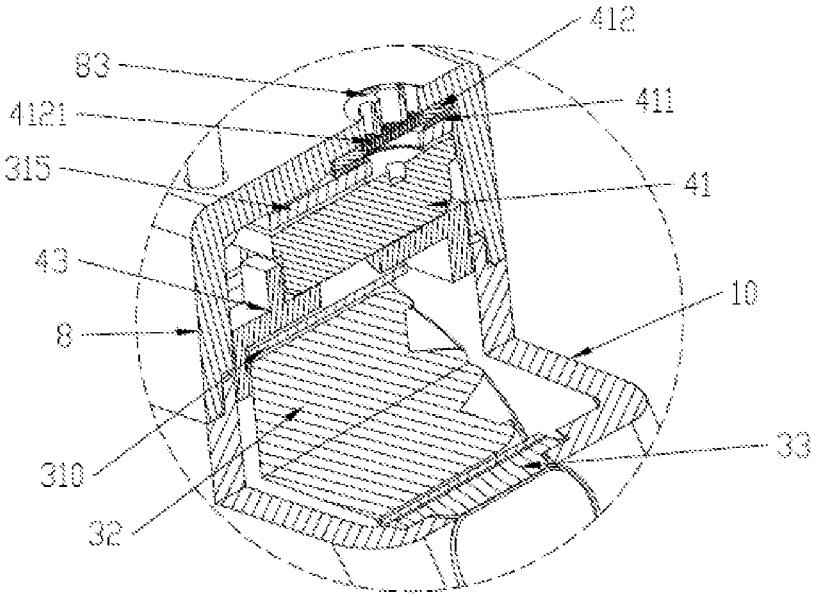
FIG. 18 is a schematic diagram of the enlarged structure at the cutaway structure shown in FIG. 17.

FIG. 17 shows a sectioning structure of the hearing aid at the position of the microphone 41, and FIG. 18 shows an enlarged structure at the sectioning structure, that is, FIG. 18 is a schematic diagram of the enlarged structure at the dashed frame A in FIG. 17. Referring to FIGS. 17 and 18, in this embodiment, the related structural design of the microphone structure is regular. The sound-guiding foam 411 and the dust-proof net 412 cooperate to protect the microphone 41, and then cooperate with the first end plate 315, bracket 43 and rear cover 8 to ensure that the microphone 41 is located at the rear of the hearing aid so as to better obtain external sound and make the size of the entire hearing aid small.

Although embodiments of the present disclosure have been shown and described, those of ordinary skill in the art may make variations, modifications, substitutions and alterations to the above embodiments within the scope of the present disclosure, which is defined by the appended claims.

What is claimed is:

1. A hearing aid microphone structure, comprising:

a microphone arranged on a front surface of a first end plate in a housing, wherein the first end plate is a part of a flexible circuit board, and the first end plate has a sound transmission hole;

a sound-guiding foam arranged on a rear surface of the first end plate, wherein the sound-guiding foam has a sound-guiding hole, and the sound-guiding hole is communicated with the sound transmission hole; and a dust-proof net arranged on the sound-guiding foam, wherein the dust-proof net has a peripheral portion and a net portion, and the net portion is blocked in front of the sound-guiding hole;

wherein the flexible circuit board further has a second end plate and an annular portion bent into an annular shape; a first connecting section is arranged between the first end plate and the annular portion, and a second connecting section is arranged between the second end plate and the annular portion; the first connecting section and the second connecting section intersect, and an intersection becomes an intersection position of the annular portion.

2. The hearing aid microphone structure according to claim 1, further comprising a bracket, wherein the bracket has an opening, the first connecting section and the second connecting section pass through the opening to be hooped together by the bracket, and the first end plate and the second end plate are fixed on the bracket.

3. The hearing aid microphone structure according to claim 2, further comprising a rear cover, wherein a rear section of the housing has a rear opening, and the rear cover covers the rear opening.

4. The hearing aid microphone structure according to claim 3, wherein the rear cover is assembled with the bracket; the microphone, the sound-guiding foam and the dust-proof net are located between the rear cover and the bracket; the first end plate and the second end plate are also located between the rear cover and the bracket.

5. The hearing aid microphone structure according to claim 4, wherein a switch is disposed on the second end plate, and the switch is located between the rear cover and the bracket.

6. The hearing aid microphone structure according to claim 3, wherein the rear cover is provided with a sound receiving port, a button hole and a wire hole.

7. The hearing aid microphone structure according to claim 1, wherein the annular portion has a pad; the housing comprises a front section and a rear section; the rear section has a side hole, and a conductive contact sheet is installed in the side hole; the conductive contact sheet is electrically connected to the pad on an outer side surface of the flexible circuit board.

8. The hearing aid microphone structure according to claim 1, wherein the intersection position is located at a rear side of the annular portion, and the first end plate and the second end plate are located behind the annular portion.

9. A hearing aid, comprising the hearing aid microphone structure according to claim 1.

10. The hearing aid according to claim 9, further comprising a bracket, wherein the bracket has an opening, the first connecting section and the second connecting section pass through the opening to be hooped together by the bracket, and the first end plate and the second end plate are fixed on the bracket.

11. The hearing aid according to claim 10, further comprising a rear cover, wherein a rear section of the housing has a rear opening, and the rear cover covers the rear opening.

12. The hearing aid according to claim 11, wherein the rear cover is assembled with the bracket; the microphone, the sound-guiding foam and the dust-proof net are located between the rear cover and the bracket; the first end plate and the second end plate are also located between the rear cover and the bracket.

13. The hearing aid according to claim 12, wherein a switch is disposed on the second end plate, and the switch is located between the rear cover and the bracket.

14. The hearing aid according to claim 11, wherein the rear cover is provided with a sound receiving port, a button hole and a wire hole.

15. The hearing aid according to claim 9, wherein the annular portion has a pad; the housing comprises a front section and a rear section; the rear section has a side hole, and a conductive contact sheet is installed in the side hole; the conductive contact sheet is electrically connected to the pad on an outer side surface of the flexible circuit board.

16. The hearing aid according to claim 9, wherein the intersection position is located at a rear side of the annular portion, and the first end plate and the second end plate are located behind the annular portion.

* * * * *